US005765611A

United States Patent [19]

Miller

[11] Patent Number: 5,765,611

[45] Date of Patent: Jun. 16, 1998

[54] CONNECTOR

[76] Inventor: Dennis L. Miller, 2862 Kuebler Rd. S, Salem, Oreg. 97302

[21] Appl. No.: 657,437

[22] Filed: Jun. 3, 1996

[51] Int. Cl.[6] ..... B65B 3/00

[52] U.S. Cl. ..... 141/383; 141/18; 141/382

[58] Field of Search ..... 141/18, 312, 368, 141/382–384, 3, 20; 285/312, 314, 358, 361

[56] References Cited

U.S. PATENT DOCUMENTS

| | | | |
|---|---|---|---|
| 1,832,639 | 11/1931 | Kneeland | 141/383 |
| 1,910,706 | 5/1933 | Malzard | 285/314 |
| 2,146,948 | 2/1939 | Feykert et al. | 141/382 |
| 2,449,659 | 9/1948 | Lane | 285/361 |
| 2,482,175 | 9/1949 | Hamilton, Jr. | 285/312 |
| 2,495,373 | 1/1950 | Grunt | 285/361 |
| 3,116,943 | 1/1964 | Wagner | 285/312 |
| 3,136,344 | 6/1964 | Kollodge | 141/383 |
| 3,441,055 | 4/1969 | Pickell | 285/314 |
| 4,688,833 | 8/1987 | Todd | 285/361 |
| 4,960,261 | 10/1990 | Scott . | |
| 5,127,436 | 7/1992 | Campion . | |
| 5,149,053 | 9/1992 | Galli . | |
| 5,224,527 | 7/1993 | McCunn et al. | 141/384 |
| 5,383,689 | 1/1995 | Wolfe . | |
| 5,465,754 | 11/1995 | Sudo . | |
| 5,566,713 | 10/1996 | Lhomer . | |
| 5,582,223 | 12/1996 | Weh et al. | 141/383 |
| 5,641,012 | 6/1997 | Silversides | 141/383 |

*Primary Examiner*—J. Casimer Jacyna
*Attorney, Agent, or Firm*—Michael E. Klicpera

[57] ABSTRACT

A lever operated connector connecting a gas filling system to individual gas cylinders. A housing is attached to a gas filling system manifold and individual gas cylinders are connected to the opening. A lever rotates a moveable piece which linearly move to tighten the air cylinder to the gas filling system. A pin fixed through the housing extending to an inclined plane on the moveable piece causes the moveable piece to move linearly when rotated.

19 Claims, 2 Drawing Sheets

FIG. 4
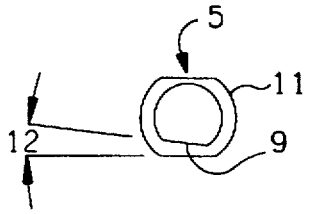
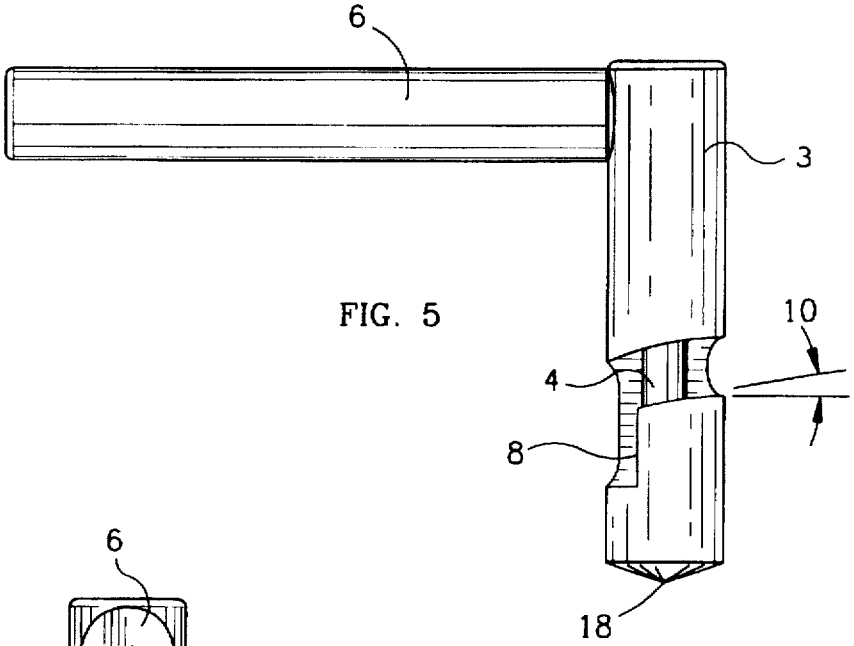
FIG. 5
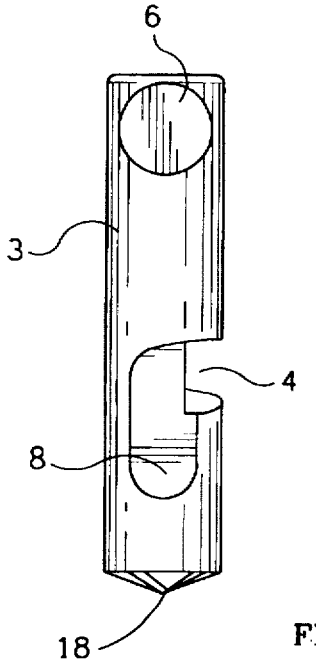
FIG. 6

CONNECTOR

BACKGROUND OF THE INVENTION

1. Field of the Invention

This invention relates to connector devices and, more particularly, to connector devices for gas filling systems of individual gas containers.

2. Prior Art

Lever operated connectors for electrical wires and devices are shown in U.S. Pat. Nos. 5,344,194 and 5,178,553. Complicated connection devices are shown in U.S. Pat. No. 5,236,005 (wall outlet for medical gas); U.S. Pat. No. 5,149,053 (disconnection safety device in a quick coupling connector); U.S. Pat. No. 4,960,261 (carbon dioxide cylinder connection in a carbonation apparatus); and U.S. Pat. No. 5,383,689 (modular connectors for pressure fluid components.

What is needed is a connector which is simple in design and simple and quick to operate.

A German connector manufactured by Weh GmbH uses a cam operated moveable piece with a bottom fitting containing a gasket and screwable attachment.

SUMMARY OF THE INVENTION

A lever operated connector for a gas filling system where a moveable piece with an inclined plane is moved linearly by rotation. A groove cut in the moveable member that spirals along the longitudinal axis of the moveable member comprises the inclined plane. A housing is attached to a manifold and is attached to a gas cylinder through an opening in the housing. A pin fixed in a housing slides on the inclined plane of the moveable piece. A gasket in the opening seals the connection.

It is an object of the invention to improve the efficiency of refilling gas cylinders.

It is another object to provide means for a visual means to check the refilling process.

It is another object to reduce the cost and time for the refilling process.

It is a final object to provide a durable and inexpensive connector.

DESCRIPTION OF THE DRAWINGS

FIG. 4 is side view of the pin.

FIG. 5 is a detailed front elevation view of the moveable piece.

FIG. 6 is a detailed side elevation view of the moveable piece.

DETAILED DESCRIPTION OF THE PREFERRED EMBODIMENTS

Figure 1:
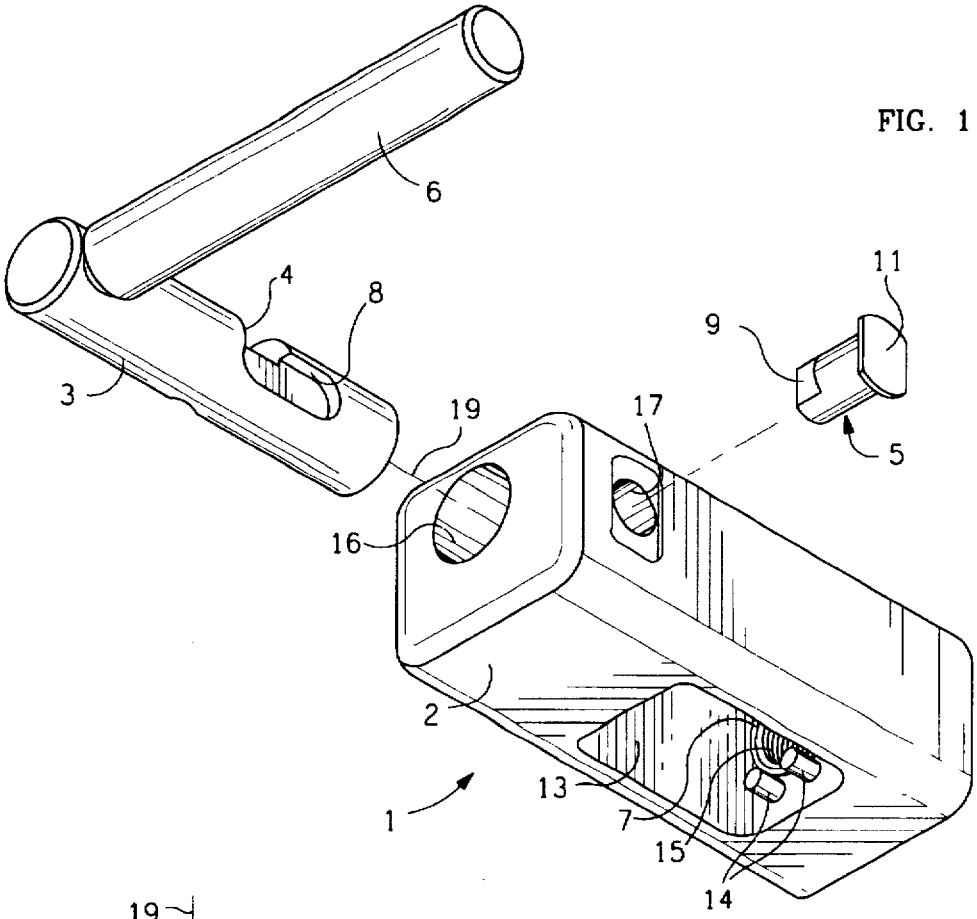
FIG. 1 is a side elevation view of the invention.
Figure 2:
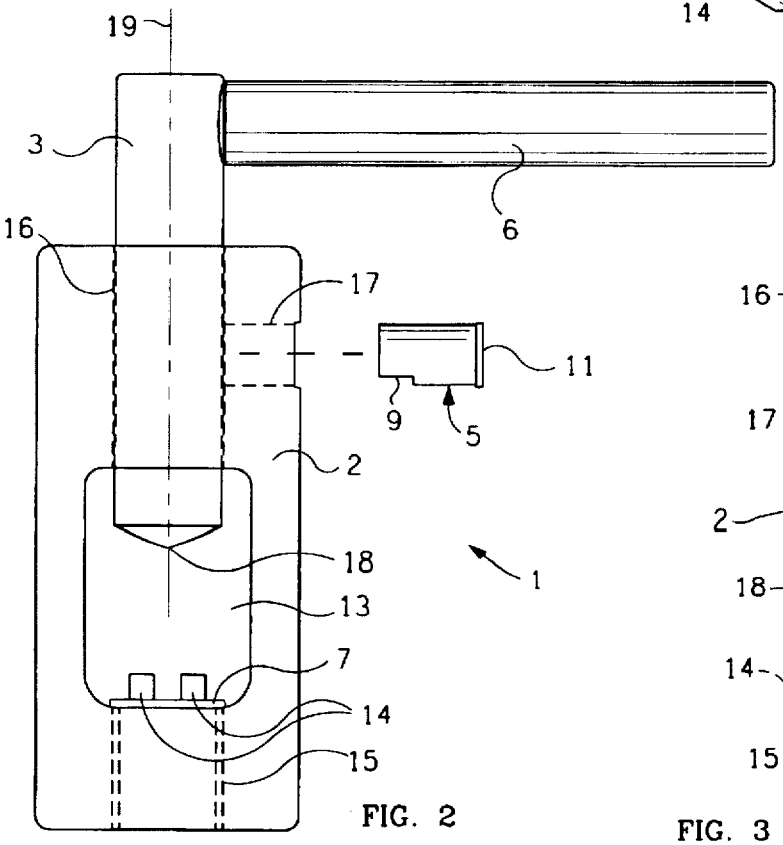
FIG. 2 is a cross-section from the front elevation view of the invention.
Figure 3:
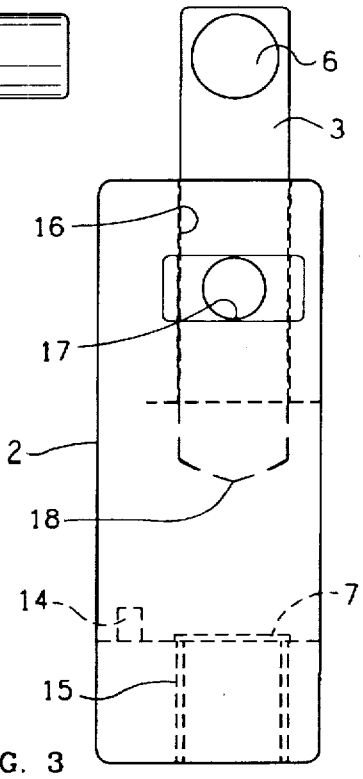
FIG. 3 is a cross-section from the side elevation view of the invention.

FIG. 1 shows the connector 1 in a front elevation view, FIG. 2 is a cross-section from the front elevation, and FIG. 3 is a cross-section from the side view. The housing 2 has a manifold opening 15 through which the supply gas is provided. The housing 2 also has an opening 13 to which the gas cylinder to be filled is inserted. A moveable piece 3 is inserted through the moveable piece opening 16 of the housing 2. A lever 6 rotates the moveable piece 3. The pin head 11 of pin 5 is shown where the pin 5 is not visible within the pin opening 17. The guide pins 14 are set in standard positions to correspond to the type of gas. The moveable piece point 18 of the moveable piece 3 fits into the gas cylinder head and forces the gas cylinder head against the gasket 7 to form a tight seal.

FIG. 4 shows the pin 5 with pin head 11. A pin slot 9 is shown and forms the angle of the flat 12 from the horizontal surface 20. As shown in FIG. 4, the sides of pin head 11 are configured with straight sides that are designed to correspond with an indentation in the housing having a similar configuration with straight sides (not shown) to rigidly and nonmovably securing of 5 thereby maintaining slot 12 in proper alignment with moveable piece 3.

FIG. 5 and FIG. 6 shows the inclined plane 4 within the moveable piece 3. The open position 8 is at one end of the inclined plane 4 comprising a short straight section aligned with the longitudinal axis A—A of the moveable piece. The angle of the inclined plane 10 is shown as measured from the horizontal plane B—B perpendicular to the longitudinal axis of the moveable member.

In operation, the connector 1 is screwably attached to the supply system through the manifold opening 15. There will generally be a plurality of connectors 1 attached to the supply system in this fashion. The head of the gas cylinder to be filled is inserted into the opening 13 of the housing 2. The guide pins 14 are set in standard position corresponding to the type of gas. In other words, an oxygen gas cylinder can only be filled by an oxygen supply system because of the arrangement of the guide pins 14. This prevents contamination by not allowing non-oxygen gas bottles with other standardized pin configurations from being coupled to the connector. After the gas cylinder is positioned in the opening 13, the lever 6 is turned preferably through an angle of 180 degrees. This causes the moveable piece 3 to rotate. With the pin 5 in the inclined plane 4, the rotation of moveable piece 3 causes it to move towards and press the head of the gas cylinder against the gasket 7 around the manifold opening 15. Generally, the moveable piece point 18 matches up with a dimple or indentation in the gas cylinder head. When the lever 6 is rotated, up to a maximum of 180 degrees, the gasket 7 seals the supply system to the gas cylinder. The lever 6 is frictionally held in place by the flat 9 of the pin 5 on the inclined plane 4 and by the pin 5 in the pin opening 17 of the housing 2. The levers 6 are visually checked to make sure all cylinders are ready to be filled. The gas supply then is activated and the cylinders filled.

To disconnect after turning off the gas supply system the levers 6 are returned to the original position and then moved out so that the pin 5 slides into the open position 8 at one end of the inclined plane 4. The filled gas cylinders can then be removed from the opening 13.

In general the top part of the housing 2 will always cover the open position 8 and the inclined plane 4 so that no debris enters. The linear travel distance of the moveable piece 3 can be controlled by the angle of the inclined plane 4, which is preferred to be 5½ degrees off the angle B—B perpendicular to the longitudinal axis A—A. The angle of the slot 12 equals the angle of the inclined plane 4 and is also preferred to be 5½ degrees.

Although the preferred embodiment of this invention has been shown and described, it should be understood that various modifications and rearrangements of the parts may be made without departing from the scope of the invention as disclosed and claimed. For example, a centerline 19 (FIG.

1) makos clear the geometric relationships that the lever 6 rotates the moveable piece 3 around the centerline 19 and advances the moveable piece 3 along the centerline 19. Note that the open portion 8 is parallel to the centerline 19.

I claim:

1. A lever operated connector for filling and discharging gas bottles comprising:

a) a housing having a longitudinal axis, said housing having a first opening substantially aligned to said longitudinal axis on one side of said housing and a second manifold opening substantially aligned to said longitudinal axis on a second side of said housing;

b) a third opening intersecting said longitudinal axis of said housing adapted to receive and become fixably attached to a manifold portion of said gas bottle, said third opening having four sides, one side perpendicular to the longitudinal axis of said housing and in proximity of said first opening and a second side perpendicular to said longitudinal axis of said housing and in proximity of said second manifold opening;

c) a moveable piece with an inclined plane, said moveable piece substantially aligned to said longitudinal axis of said housing, said moveable piece slidably received within said first opening of said housing;

d) a fixable mounted pin within said housing extending to said an inclined plane of said moveable piece;

e) a lever attached to one end of said moveable piece to advance and to rotate said moveable piece; and f) a gasket fixed to said second side within said third opening within said housing.

2. The connector as recited in claim 1 wherein said lever rotates approximately 180 degrees.

3. The connector as recited in claim 1 wherein a groove continuous with and at one end of said inclined plane extends straight along the longitudinal axis of said moveable piece comprising an open position.

4. The connector as recited in claim 1 wherein said pin includes a slot for sliding within a groove in said inclined plane.

5. The connector as recited in claim 4 wherein said inclined plane is 5 and ½ degrees from a plane perpendicular to said longitudinal axis.

6. The connector as recited in claim 4 wherein a horizontal of the head of said pin is 5 and ½ degrees from the angle of said slot.

7. The connector as recited in claim 1 further comprising at least one guide pin in said opening.

8. The connector as recited in claim 7 further comprising a point on the end of said moveable piece.

9. The connector as recited in claim 8 wherein said inclined plane is contained within said housing.

10. A lever operated connector for filling and discharging gas bottles comprising:

a) a housing having a longitudinal axis said housing having a bore substantially aligned to said longitudinal axis on one side of said housing and a threaded opening substantially aligned to said longitudinal axis on a second side of said housing;

b) a gas bottle manifold opening intersecting said longitudinal axis of said housing adapted to receive and become fixably attached to a manifold portion of said gas bottle;

c) a moveable piston with an elongated shaft and a groove configured as a spiral located within the shaft of said moveable piston, said moveable piece having a longitudinal axis and said moveable piston slidably received within said bore of said housing;

d) a fixable mounted pin within said housing extending to said groove of said moveable piece;

e) a lever to advance and to rotate said moveable piece along and about, respectively, a centerline of said moveable piece; and f) a gasket fixed within said housing.

11. The connector as recited in claim 10 wherein said lever rotates approximately 180 degrees.

12. The connector as recited in claim 10 wherein a groove continuous with and at one end of said inclined plane extends straight along the longitudinal axis of said moveable piece comprising an open position.

13. The connector as recited in claim 12 wherein said open position is parallel to said centerline.

14. The connector as recited in claim 10 wherein said pin includes a slot for sliding within a groove in said inclined plane.

15. The connector as recited in claim 14 wherein said inclined plane is 5 and ½ degrees from a plane perpendicular to said centerline of said moveable member.

16. The connector as recited in claim 14 wherein a horizontal of the head of said pin is 5 and ½ degrees from the angle of said slot.

17. The connector as recited in claim 10 further comprising at least one guide pin in said opening.

18. The connector as recited in claim 17 further comprising a point on the end of said moveable piece.

19. The connector as recited in claim 18 wherein said inclined plane is contained with said housing.

* * * * *